US010563443B1

(12) United States Patent
Yang

(10) Patent No.: US 10,563,443 B1
(45) Date of Patent: Feb. 18, 2020

(54) DOOR HINGE

(71) Applicant: Ever Yang Industry Co., Ltd., Xiushui Township (TW)

(72) Inventor: Min-Chieh Yang, Xiushui Township (TW)

(73) Assignee: Ever Yang Industry Co., Ltd., Xiushui Township (TW)

( * ) Notice: Subject to any disclaimer, the term of this patent is extended or adjusted under 35 U.S.C. 154(b) by 0 days.

(21) Appl. No.: 16/358,849

(22) Filed: Mar. 20, 2019

(51) Int. Cl.

| | |
|---|---|
| ***E05D 5/02*** | (2006.01) |
| ***E05F 3/20*** | (2006.01) |
| ***E05F 1/12*** | (2006.01) |
| ***E05F 3/10*** | (2006.01) |

(52) U.S. Cl.
CPC ..... *E05F 3/20* (2013.01); *E05F 1/1253* (2013.01); *E05F 3/104* (2013.01); *E05Y 2201/21* (2013.01); *E05Y 2201/474* (2013.01); *E05Y 2900/132* (2013.01)

(58) Field of Classification Search
CPC ..... E05D 5/0246; E05D 2005/0261; E05D 2005/0269; E05D 7/081; E05D 7/08; E05D 11/1028; E05D 11/1035; E05D 11/02; E05D 11/105; E05D 11/1064; E05D 3/02; E05D 3/12; E05D 5/04; E05D 5/12; E05D 5/14; E05D 7/0415; E05D 2011/1092; E05Y 2600/502; E05Y 2600/60; E05Y 2201/48; E05Y 2900/114; E05F 11/385; E06B 3/54; A47K 3/362; A47K 2003/367; A47F 3/12; A47F 3/125; Y10T 16/534; Y10T 16/5326; Y10T 16/554
See application file for complete search history.

(56) References Cited

U.S. PATENT DOCUMENTS

| | | | | |
|---|---|---|---|---|
| 5,867,869 | A * | 2/1999 | Garrett | A47K 3/36 16/252 |
| 8,720,005 | B2 * | 5/2014 | Cheng | E05D 5/0246 16/252 |
| 10,400,495 | B1 * | 9/2019 | Yu | E05F 3/10 |
| 2010/0199459 | A1 * | 8/2010 | Bacchetti | E05F 3/20 16/54 |
| 2012/0216370 | A1 * | 8/2012 | Chow | E05D 5/0246 16/54 |
| 2012/0279015 | A1 * | 11/2012 | Hung | E05F 3/12 16/297 |
| 2014/0068893 | A1 * | 3/2014 | Hung | E05F 3/20 16/52 |

FOREIGN PATENT DOCUMENTS

| | | | | |
|---|---|---|---|---|
| DE | 202014103333 U1 * | 8/2014 | | E05F 1/1253 |
| GB | 2484527 B * | 5/2015 | | |
| TW | M412227 | 9/2011 | | |

* cited by examiner

*Primary Examiner* — Chuck Y Mah
(74) *Attorney, Agent, or Firm* — Burris Law, PLLC

(57) ABSTRACT

A door hinge includes a connecting unit, a moving unit, a rotating unit and a resilient unit. The connecting unit includes a connecting member and a shaft seat that are connected to each other. The shaft seat has a connecting hole that has first and second sections. The rotating unit includes a camshaft that rotatably extends through the shaft seat, and that is connected to the moving unit. The resilient unit is disposed in the connecting hole of the shaft seat, and has a plurality of coils. A quantity of coils in the first section is less than a quantity of coils in the second section. The moving unit is pivotable to drive the camshaft to rotate against a resilient force of the coils of the resilient unit.

15 Claims, 10 Drawing Sheets

DOOR HINGE

FIELD

The disclosure relates to a door hinge, and more particularly to a door hinge for use with a glass door.

BACKGROUND

Referring to FIG. 1, a conventional door hinge 1 disclosed in Taiwanese Utility Model Patent No. M412227 has a first connecting member 11, a second connecting member 12, a camshaft 13, a threaded member 14, a sliding member 15, a resilient unit 16, and a fluid chamber sleeve 17.

The second connecting member 12 is connected to a door panel (not shown). The camshaft 13 interconnects the first and second connecting members 11, 12, and is rotatable between a normal state and an inclined state. The threaded member 14 is screwed to one end of the camshaft 13 through the second connecting member 12 such that the camshaft 13 is fixed to the second connecting member 12. The sliding member 15 and the resilient unit 16 are mounted between the first connecting member 11 and the camshaft 13, such that there exists a gap between the sliding member 15 and the camshaft 13. The resilient unit 16 is capable of driving the camshaft 13 from the inclined state back to the normal state via the sliding member 15. The fluid chamber sleeve 17 is mounted to the first connecting member 11, and cooperates with the sliding member 15 to define a fluid chamber 171. The conventional door hinge 1 further has a fluid passage 18 that is in spatial communication with the fluid chamber 171 and the gap (between the sliding member 15 and the camshaft 13), such that a damping fluid which is in the fluid chamber 171 may be guided to flow in and out of the fluid passage 18 via the gap.

Therefore, when an external force drives the door panel and the second connecting member 12 to pivot relative to the first connecting member 11, the camshaft 13 is driven to rotate from the normal state toward the inclined state, thereby driving the sliding member 15 to compress the resilient unit 16. During this time, the damping fluid in the fluid chamber 171 flows into the abovementioned gap and slows down the movement of the sliding member 15 and the rotation of the camshaft 13, so that the pivotal movement of the second connecting member 12 and the door panel is slowed down as well. When the external force is eliminated, the sliding member 15 is driven by the restoring force of the resilient unit 16 to drive the camshaft 13 back to the normal state. At this time, the damping fluid in the gap is driven to flow back into the fluid chamber 171 via the fluid passage 18. In such a manner, the damping fluid produces a damping effect so that the rotation of the camshaft 13 and the pivotal movement of the second connecting member 12 and the door panel are slowed down to prevent abrupt opening and closing of the door panel.

In order to provide enough resilient force for driving the camshaft 13 back to the normal state, the resilient unit 16 of the conventional door hinge includes two resilient members 161, 162. However, as the resilient force of the resilient unit 16 increases, the external force needed to push the door panel open has to increase as well, which is rather inconvenient from a user's perspective.

SUMMARY

Therefore, the object of the disclosure is to provide a door hinge that can alleviate the drawback of the prior art.

A door hinge according to the present disclosure includes a connecting unit, a moving unit, a rotating unit and a resilient unit.

The connecting unit includes a connecting member and a shaft seat. The shaft seat is connected to the connecting member and is formed with a shaft hole and a connecting hole. The shaft hole extends through the shaft seat along a shaft axis. The connecting hole extends along a connecting axis that is transverse to the shaft axis, has one end that is spatially communicated with the shaft hole and the other end that is covered by the connecting member, and has a first section and a second section that are respectively proximate to and distal from the shaft hole and that are connected to each other. The moving unit includes first and second moving members that are adapted to cooperatively clamp a door panel therebetween. The rotating unit includes a camshaft that rotatably extends through the shaft hole of the shaft seat, and that is connected to the first moving member. The resilient unit is disposed in the connecting hole, extends along the connecting axis, is connected to the camshaft, and has a plurality of coils that surround the connecting axis.

A quantity of coils in the first section is less than a quantity of coils in the second section. The moving unit is pivotable about the shaft axis to drive the camshaft to rotate about the shaft axis against a resilient force of the coils of the resilient unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
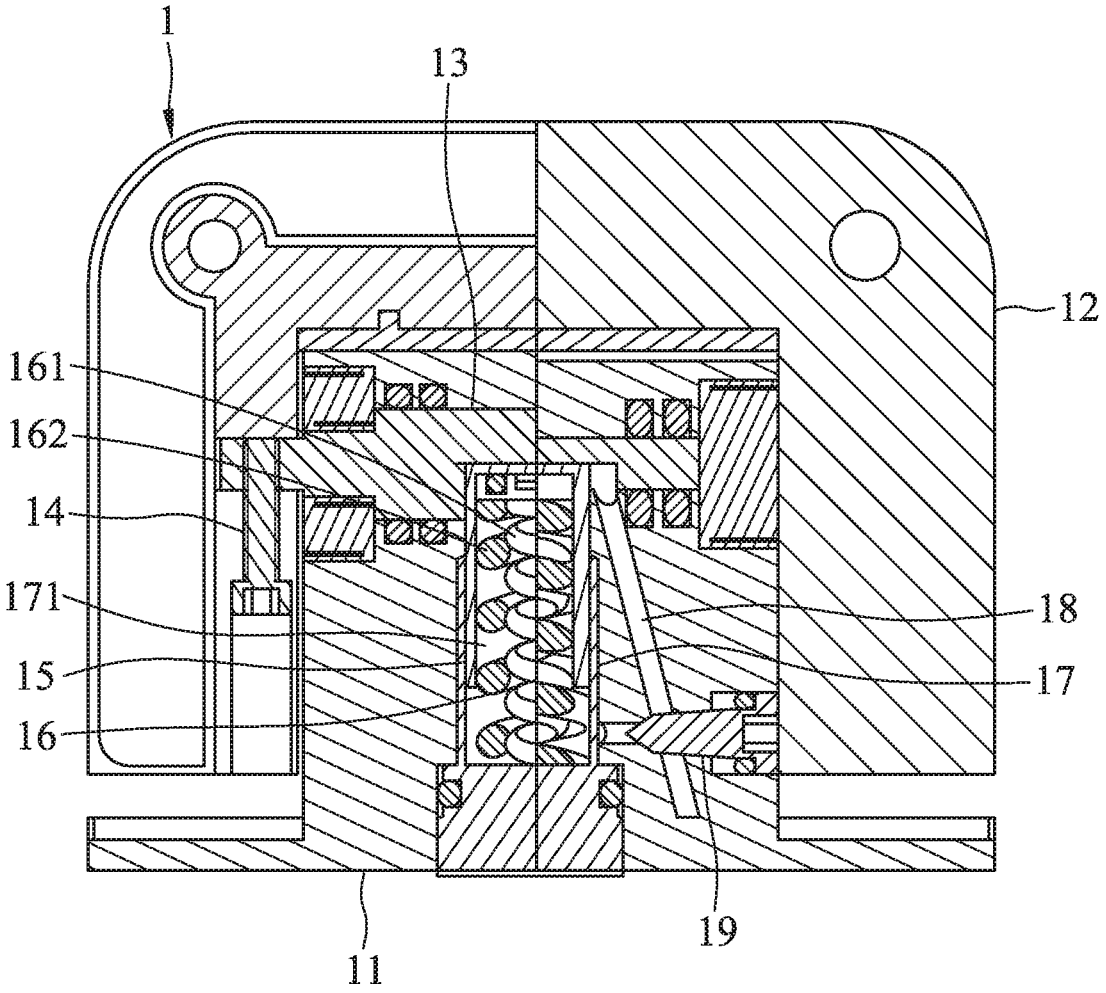
FIG.1 PRIOR ART
FIG. 1 is an offset sectional view of a conventional door hinge disclosed in Taiwanese Utility Model Patent No. M412227.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
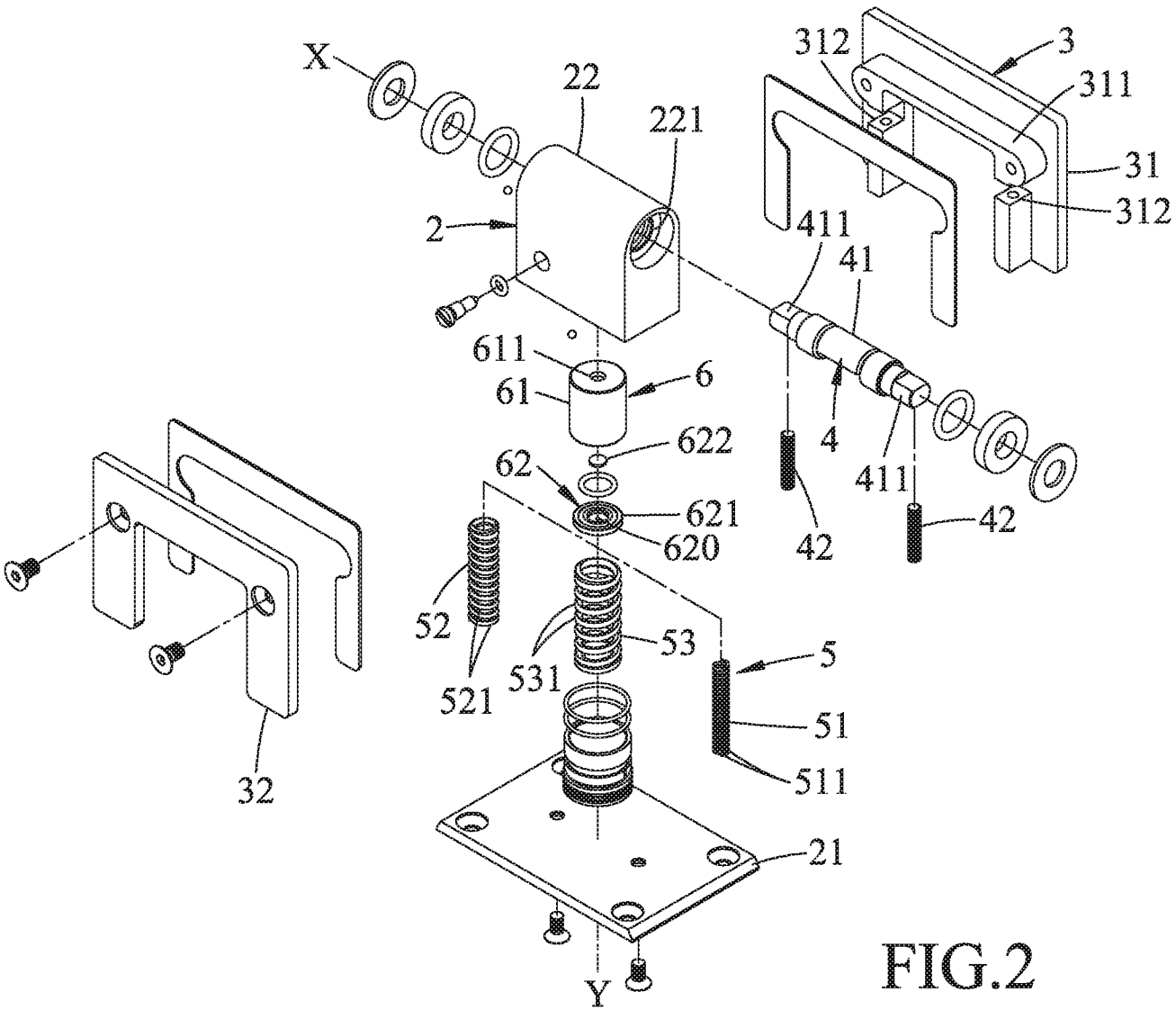
FIG. 2 is an exploded perspective view of a first embodiment of a door hinge according to the disclosure.
Figure 3:
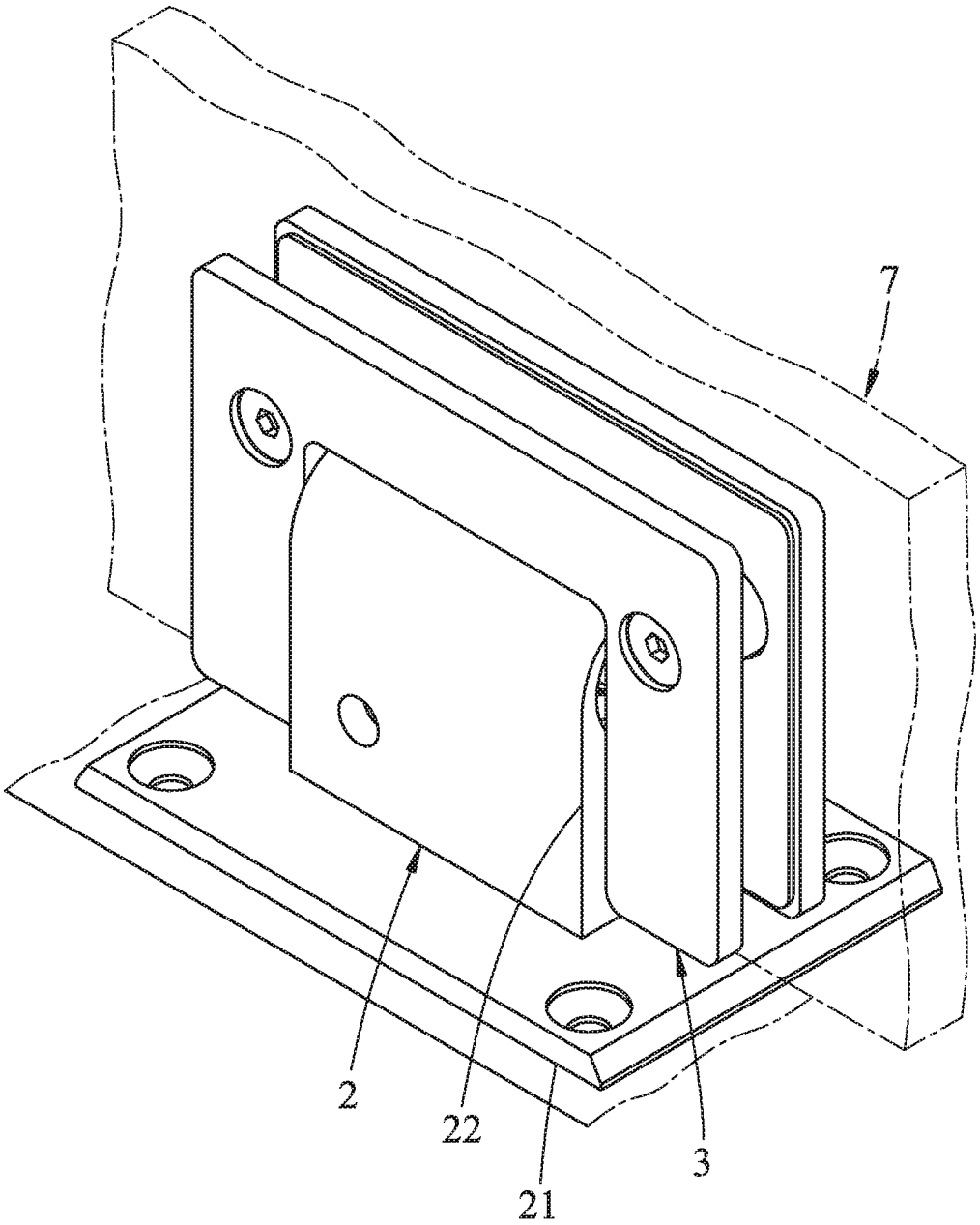
FIG. 3 is a perspective view, illustrating a door panel being installed in the first embodiment.
Figure 4:
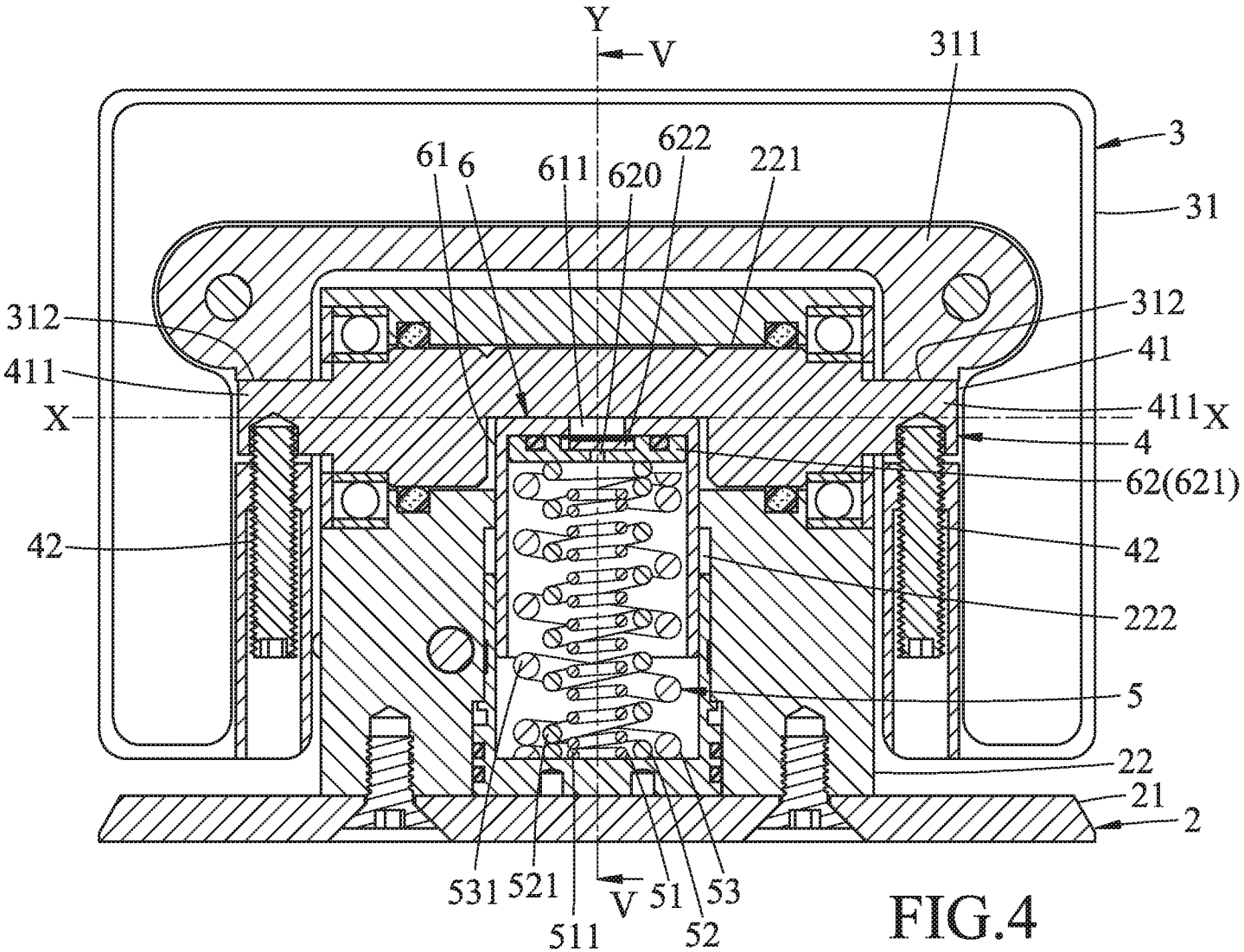
FIG. 4 is a sectional view of the first embodiment.

Referring to FIGS. 2, 3 and 4, a first embodiment of a door hinge according to the present disclosure is adapted to interconnect a door panel 7 and a door frame (not shown) such that the door panel 7 is pivotable relative to the door frame.

The door hinge includes a connecting unit 2, a moving unit 3, a rotating unit 4, a resilient unit 5 and a damping unit 6.

The connecting unit 2 includes a connecting member 21 and a shaft seat 22. The connecting member 21 is adapted to be connected to the door frame. The shaft seat 22 is connected to the connecting member 21 and is formed with a shaft hole 221 and a connecting hole 222. The shaft hole 221 extends through the shaft seat 22 along a shaft axis (X). The connecting hole 222 extends along a connecting axis (Y) that is transverse to the shaft axis (X), has one end that is spatially communicated with the shaft hole 221 and the other end that is covered by the connecting member 21, and is adapted for retaining damping fluid therein.

Figure 5:
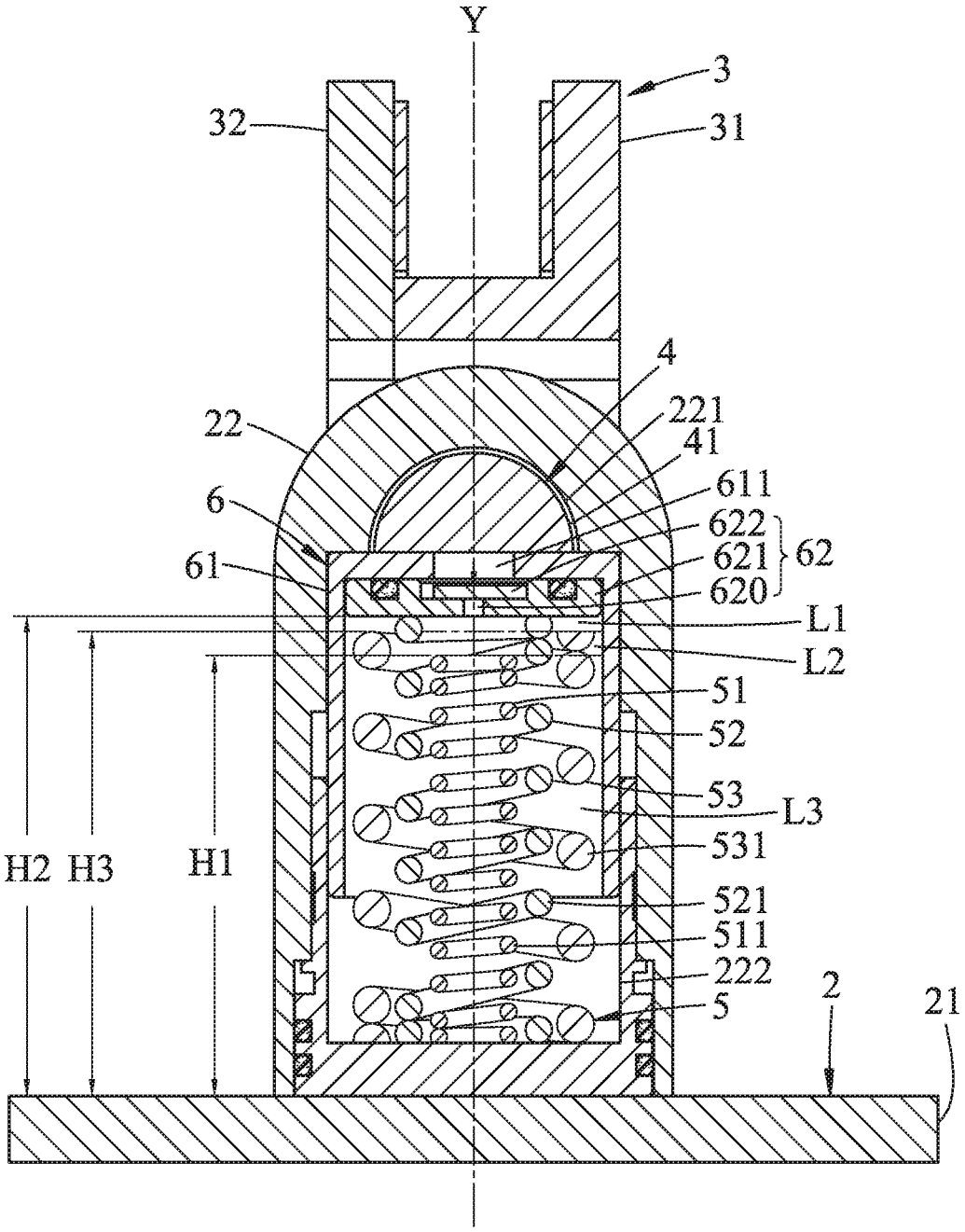
FIG. 5 is a sectional view taken along line V-V in FIG. 4, illustrating a camshaft of the first embodiment in a normal state.

Referring to FIG. 5, in this embodiment, the connecting hole 222 has a first section (L1), a second section (L2) and a third section (L3). The first and third sections (L1, L3) are respectively proximate to and distal from the shaft hole 221. The second section (L2) interconnects the first and third sections (L1, L3).

Referring to FIGS. 2 to 5, the moving unit 3 includes first and second moving members 31, 32 that are adapted to cooperatively clamp the door panel 7 therebetween. The first moving member 31 has a U-shaped securing subunit 311 that protrudes toward the second moving member 32. The securing subunit 311 is formed with two securing notches 312 that are spaced apart from each other along the shaft axis (X).

The rotating unit 4 includes a camshaft 41 and two shaft fasteners 42. The camshaft 41 rotatably extends along the shaft axis (X) through the shaft hole 221 of the shaft seat 22, and has two end portions 411 that are transverse to the protruding subunit 311 of the first moving member 31 of the moving unit 3, and that are respectively received in the securing notches 312 of the protruding subunit 311. The shaft fasteners 42 extend in a direction of the connecting axis (Y) from the protruding subunit 311 of the first moving member 31, and respectively engage the two end portions 411 of the camshaft 41 such that the camshaft 41 is connected to the first moving member 31, and that the moving unit 3 is pivotable about the shaft axis (X) relative to the connecting unit 2 for driving the camshaft 41 to rotate about the shaft axis (X).

The resilient unit 5 is disposed in the connecting hole 222, extends along the connecting axis (Y), is connected to the camshaft 41, and has a plurality of coils that surround the connecting axis (Y). Specifically, in this embodiment, the resilient unit 5 includes a first coil spring 51, a second coil spring 52 and a third coil spring 53. The second coil spring 52 is sleeved on the first coil spring 51, and the third coil spring 53 is sleeved on the second coil spring 52. Each of the first, second and third coil springs 51, 52, 53 surrounds the connecting axis (Y) and has a plurality of coils 511, 521, 531. The coils 511, 521, 531 of the first, second and third coil springs 51, 52, 53 constitute the coils of the resilient units 5.

A length (H1) of the first coil spring 51 along the connecting axis (Y) is different from at least one of a length (H2) of the second coil spring 52 along the connecting axis (Y) and a length (H3) of the third coil spring 53 along the connecting axis (Y).

In the present embodiment, the length (H3) of the third coil spring 53 is greater than the length (H1) of the first coil spring 51 and is smaller than the length (H2) of the second coil spring 52. A difference between the length (H2) of the second coil spring 52 and the length (H3) of the third coil spring 53 equals the length of the first section (L1) of the connecting hole 222 along the connecting axis (Y). A difference between the length (H3) of the third coil spring 53 and the length (H1) of the first coil spring 53 equals the length of the second section (L2) of the connecting hole 222 along the connecting axis (Y). The length (H1) of the first coil spring 51 equals the length of the third section (L3) of the connecting hole 222 along the connecting axis (Y). In such a configuration, a quantity of the coils 521, 531 in the second section (L2) is greater than a quantity of the coils 521 in the first section (L1) and is smaller than a quantity of the coils 511, 531, 521 in the third section (L3).

It should be noted that, in other embodiments of the disclosure, the length (H3) of the third coil spring 53 may be equal or smaller than any of the lengths (H1, H2) of the first and second coil springs 51, 52.

Figure 6:
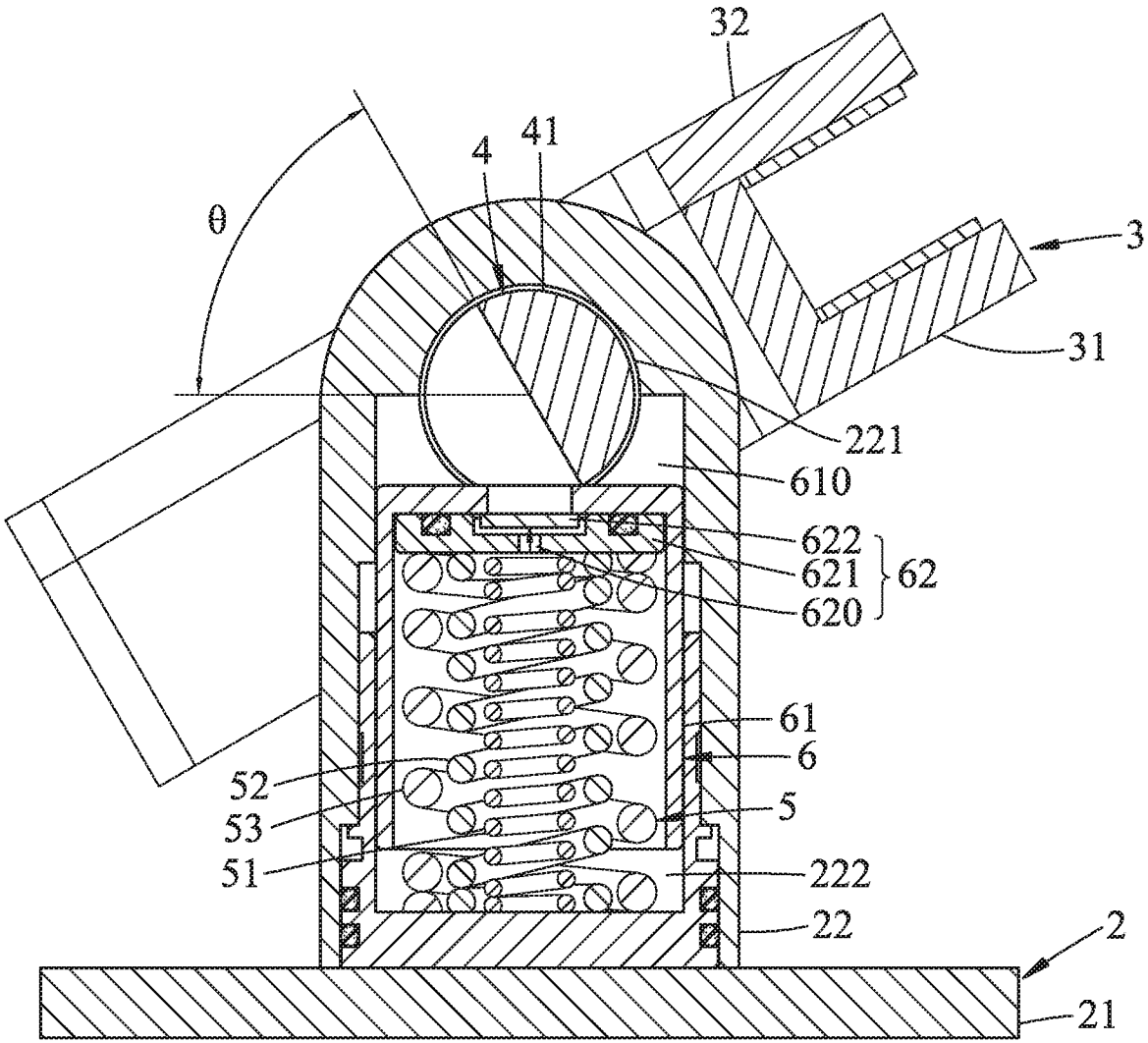
FIG. 6 is another sectional view similar to FIG. 5, illustrating the camshaft in an inclined state.
Figure 7:
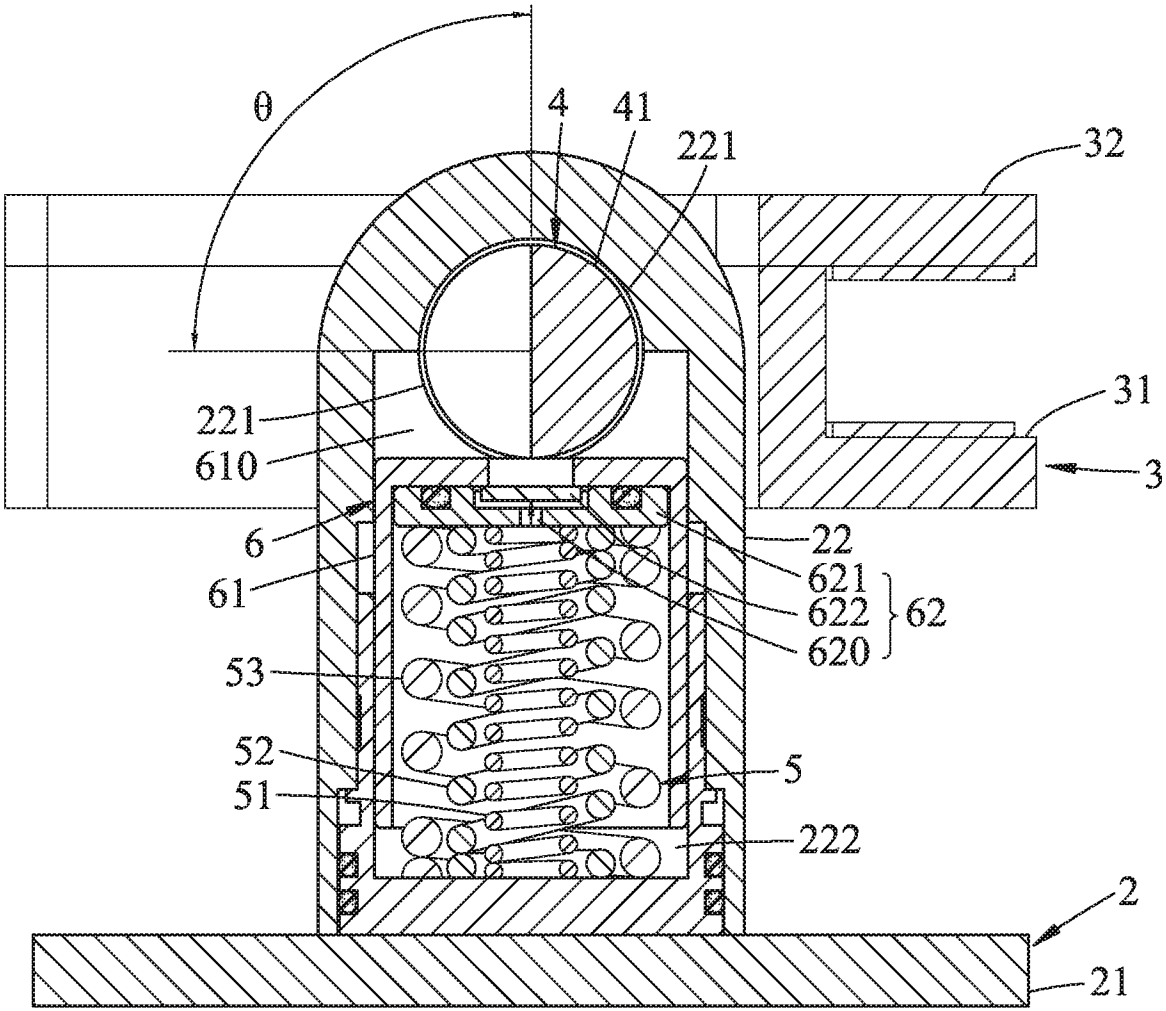
FIG. 7 is yet another sectional view similar to FIG. 5, illustrating the camshaft in another inclined state.

The camshaft 41 of the rotating unit 4 is rotatable about the shaft axis (X) between a normal state (as shown in FIG. 5), where the coils of the resilient unit 5 are not compressed by the camshaft 41, and an inclined state (as shown in FIGS. 6 and 7), where the camshaft 41 is rotated by an angle (θ) from the normal state, and where at least a portion of the coils of the resilient unit 5 is compressed by the camshaft 41 via a cam action between the camshaft 41 and the resilient unit 5. The angle (θ) ranges from 0 to 90 degrees.

The damping unit 6 includes a sliding member 61 and a valve subunit 62. The sliding member 61 is disposed in the connecting hole 222 of the connecting unit 2 and between the resilient unit 5 and the camshaft 41 of the rotating unit 4, abuts against the camshaft 41, and is movable along the connecting axis (Y). The sliding member 61 cooperates with the shaft seat 22 of the connecting unit 2 and the camshaft 41 to define a fluid chamber 610 (see FIGS. 6 and 7) which overlaps a portion of the connecting hole 222, and is formed with a fluid hole 611 that spatially interconnects the fluid chamber 610 and the connecting hole 222. The valve subunit 62 is disposed between the sliding member 61 and the resilient unit 5 (i.e., the resilient unit 5 is connected to the camshaft 41 via the sliding member 61 and the valve unit 62), and includes a stationary plate 621 and a valve plate 622. The stationary plate 621 is formed with a valve hole 620 spatially communicating with the fluid hole 611 and the connecting hole 222. The valve plate 622 is disposed between the stationary plate 621 and the sliding member 61. Specifically, the valve plate 622 is movable relative to the stationary plate 621 between an open position (as shown in FIGS. 6 and 7) during the movement of the camshaft 41 of the rotating unit 4 from the normal state to the inclined state, and a closed position (as shown in FIG. 5) during the movement of the camshaft 41 from the inclined state to the normal state. When the valve plate 622 is at the open position, the valve plate 622 moves away from the valve hole 620, and a center of the valve plate 622 is slightly misaligned from a center of the fluid hole 611 along the connecting axis (Y), thereby permitting the damping fluid inside the sliding member 61 to flow into the fluid chamber 610 via the valve hole 620 and the fluid hole 611. When the valve plate 622 is at the closed position, the valve plate 622 covers the valve hole 620 to block the damping fluid in the fluid chamber 610 from flowing through the valve hole 620.

Referring to FIGS. 3 to 7, when an external force is applied to the door panel 7 to pivot the moving unit 3 about the shaft axis (X) relative to the connecting unit 2, the first moving member 31 of the moving unit 3 drives the camshaft 41 to rotate about the shaft axis (X) and to drive the sliding member 61 to compress the resilient unit 5. When the resilient unit 5 is being compressed, the damping fluid inside the sliding member 61 is driven to push the valve plate 622 to the open position, such that the damping fluid inside the sliding member 61 is permitted to flow into the fluid chamber 610 via the valve hole 620 and the fluid hole 611 to dampen movements of the sliding member 61 and the camshaft 41.

Initially, when the sliding member 61 is driven by the camshaft 41 to start moving, the sliding member 61 only compresses the second coil spring 52, such that only the resilient force of the second coil spring 52 is exerted on the sliding member 61. As the angle (θ) increases, the sliding member 61 further compresses the third coil springs 53 (see FIG. 6). At this point, the combined resilient force of the second and third coil springs 52, 53 is exerted on the sliding member 61. Finally, as the angle (θ) approaches 90 degrees (see FIG. 7), the sliding member 61 further compresses the first coil spring 51, and the greater combined resilient force of the first, second and third coil springs 51, 52, 53 is exerted on the sliding member 61. Such configuration of the coil springs 51, 52, 53, combined with the abovementioned damping effect of the damping fluid, produces a multistage damping effect that helps prevent abrupt opening of the door panel 7.

When the external force is eliminated, the sliding member 61 is driven by the resilient force of the resilient unit 5 to move away from the connecting member 21 of the connecting unit 2, thereby driving the camshaft 41 to rotate about the shaft axis (X) in an opposite direction, and resulting in a pivotal movement of the moving unit 3 and the door panel 7 in the same opposite direction.

During the abovementioned process, in which movement of the sliding member 61 results in compression of volume of the fluid chamber 610, the valve plate 622 is driven by the damping fluid in the fluid chamber 610 to move to the closed position to block the valve hole 620. As a result, the damping fluid in the fluid chamber 610 is only permitted to flow back into the connecting hole 222 via a fluid passage (not shown) and, therefore, produces a damping effect which slows down the movement of the sliding member 61.

In addition, by virtue of the abovementioned configuration of the coil springs 51, 52, 53, during the movement of the sliding member 61 away from the connecting member 21, the resilient force is provided by the first, second and third coil springs 51, 52, 53, and then by the second the third coil springs 52, 53, and eventually only by the second coil spring 52, so that the resilient force of the resilient unit 5 decreases in magnitude and rotation of the camshaft 4 is slowed down.

More specifically, as the door panel 7 pivots towards the door frame, the abovementioned movement of the damping fluid and changes of the resilient force of the resilient unit 5 cooperatively slow down the rotation of the camshaft 41 and the pivotal movement of the door panel 7, preventing abrupt closing or slamming of the door panel 7 on the door frame.

Figure 8:
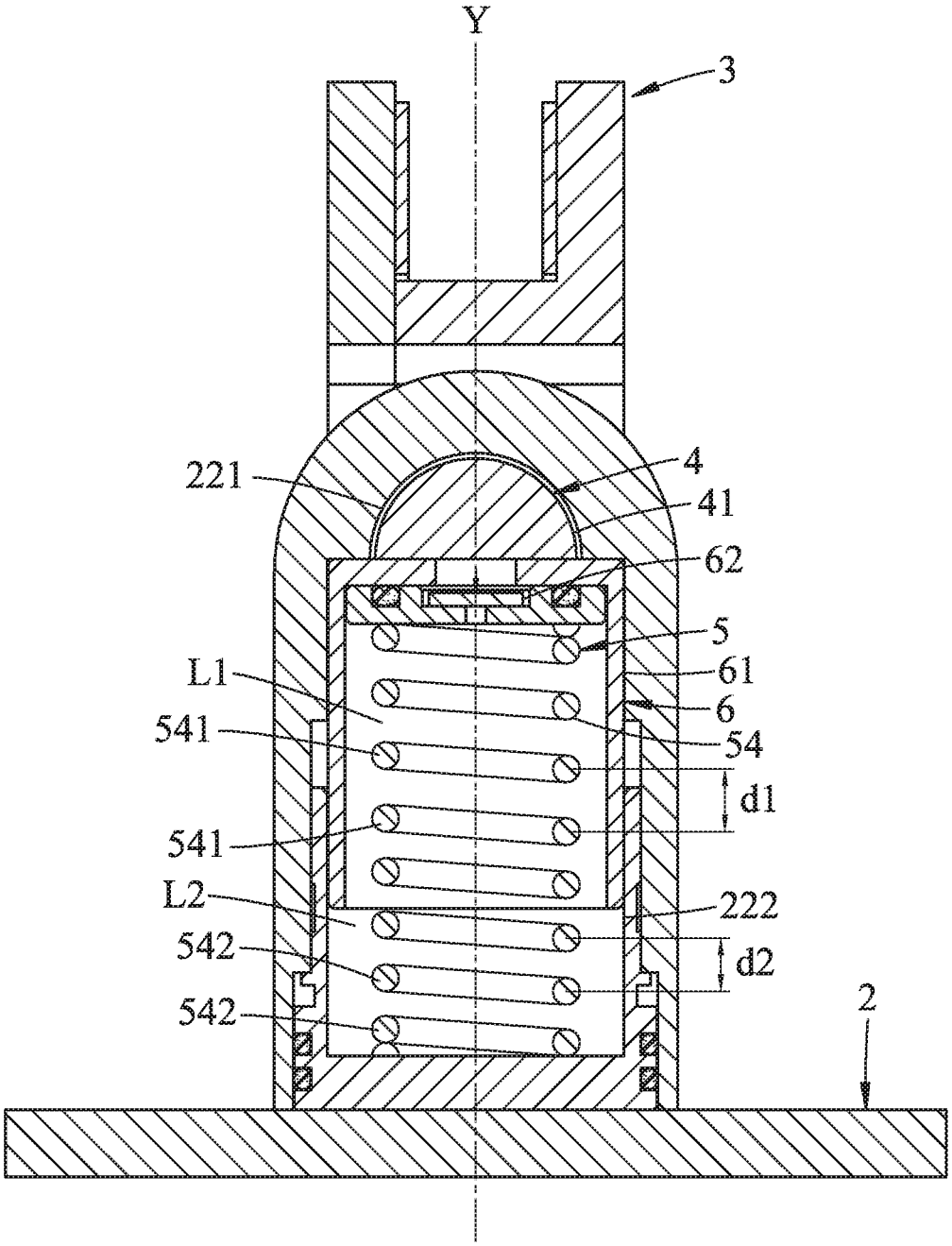
FIG. 8 is a sectional view of a second embodiment of the door hinge according to the disclosure, illustrating a camshaft in a normal state.
Figure 9:
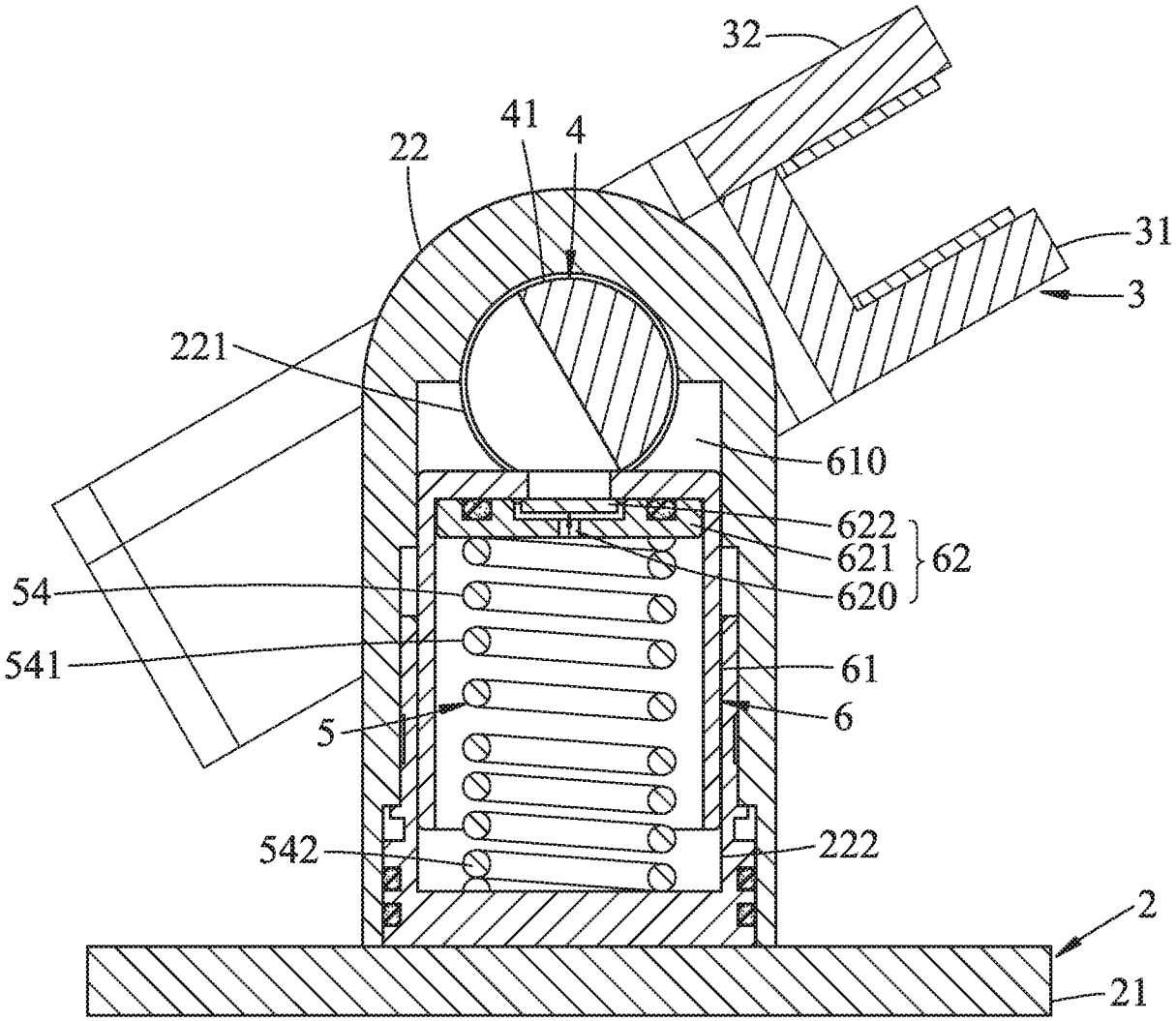
FIG. 9 is another sectional view similar to FIG. 8, illustrating the camshaft in an inclined state.
Figure 10:
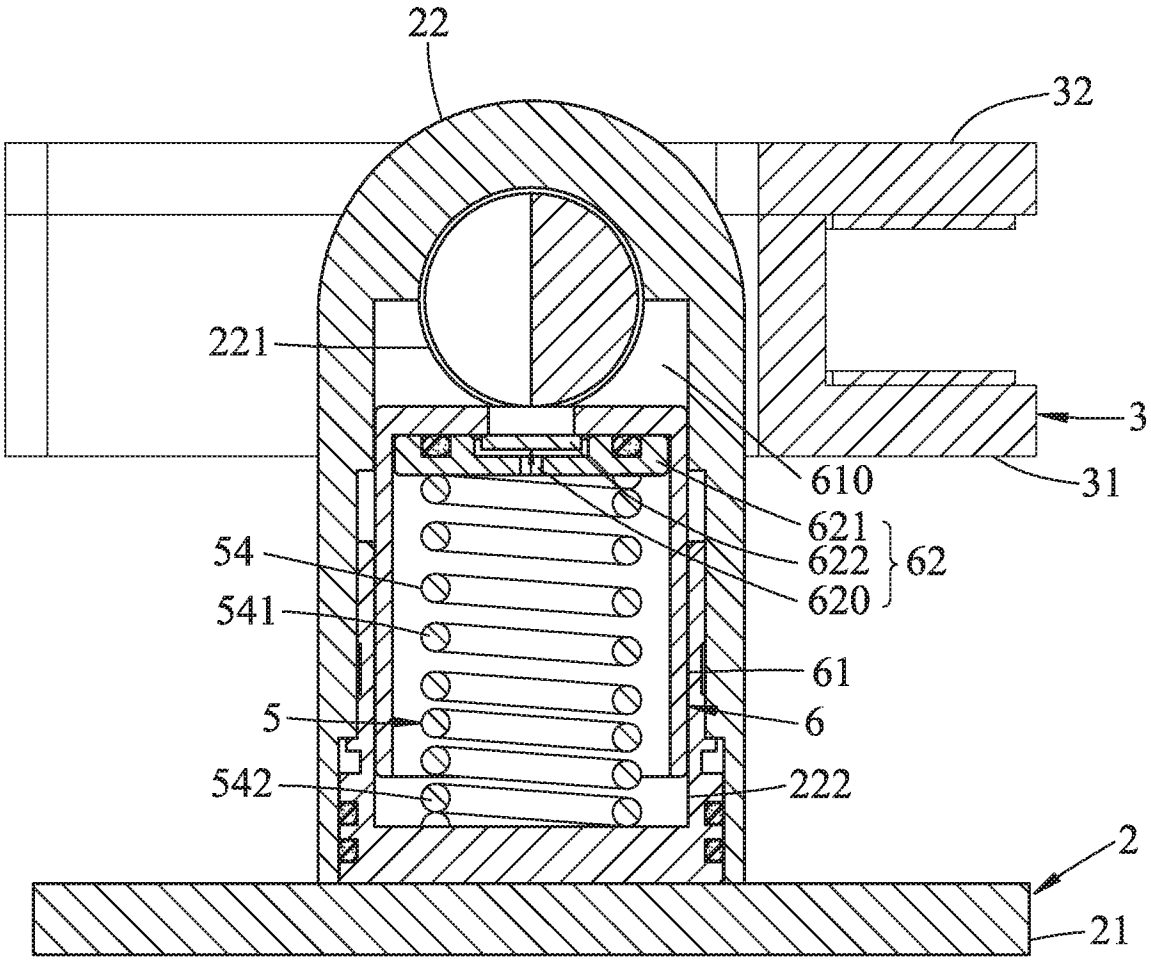
FIG. 10 is yet another sectional view similar to FIG. 8, illustrating the camshaft in another inclined state.

Referring to FIGS. 8, 9 and 10, a second embodiment of the disclosure is similar to the first embodiment, and the difference therebetween is detailed as follows.

The connecting hole 222 of the connecting unit 2 has a first section (L1) and a second section (L2) that are respectively proximate to and distal from the shaft hole 221 of the connecting unit 2 and that are connected to each other.

The resilient unit 5 includes a resilient member 54 that surrounds the connecting axis (Y), and that has a plurality of coils 541, 542 constituting the coils of the resilient unit 5. The coils 541 are disposed in the first section (L1) of the connecting hole 222, and the coils 542 are disposed in the second section (L2) of the connecting hole 222. A pitch (d1) of any adjacent pair of coils 541 is greater than a pitch (d2) of any adjacent pair of coils 542, such that a quantity of coils in the first section (L1) is less than a quantity of coils in the second section (L2). Therefore, when being compressed, the coils 541 have a weaker resilient force than do the coils 542.

Initially, when the sliding member 61 is driven by the camshaft 41 to move, the sliding member 61 compresses the coils 541 of the resilient member 54 and, therefore, the resilient force of the coils 541 is exerted thereon. As the sliding member 61 moves further, the sliding member 61 compresses the coils 541, 542 of the resilient member 54 at the same time, and the combined resilient force of the coils 541, 542 is exerted on the sliding member 61.

Similar to the first embodiment, such a configuration of the coil spring 54 produces a multistage damping effect that helps prevent abrupt opening and closing of the door panel 7.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A door hinge comprising:

a connecting unit including a connecting member, and a shaft seat that is connected to said connecting member and that is formed with a shaft hole extending therethrough along a shaft axis, and a connecting hole extending along a connecting axis that is transverse to the shaft axis, having one end that is spatially communicated with said shaft hole and the other end that is covered by said connecting member, and having a first section and a second section that are respectively proximate to and distal from said shaft hole and that are connected to each other;

a moving unit including first and second moving members that are adapted to cooperatively clamp a door panel therebetween;

a rotating unit including a camshaft that rotatably extends through said shaft hole of said shaft seat, and that is connected to said first moving member; and a resilient unit disposed in said connecting hole, extending along the connecting axis, connected to said camshaft, and having a plurality of coils that surround the connecting axis;

wherein a quantity of coils in said first section is less than a quantity of coils in said second section, and wherein said moving unit is pivotable about the shaft axis to drive said camshaft to rotate about the shaft axis against a resilient force of said coils of said resilient unit.

2. The door hinge as claimed in claim 1, wherein:

said resilient unit includes a first coil spring and a second coil spring, each of said first and second coil springs surrounding the connecting axis and having a plurality of coils, said coils of said first and second coil springs constituting said coils of said resilient units; and a length of said first coil spring along the connecting axis is different from a length of said second coil spring along the connecting axis.

3. The door hinge as claimed in claim 2, wherein said camshaft is rotatable about the shaft axis between a normal state, where said coils of said resilient unit are not compressed by said camshaft, and an inclined state, where said camshaft is rotated by an angle from the normal state, and where said coils of said resilient unit are compressed by said camshaft.

4. The door hinge as claimed in claim 3, wherein:

said connecting hole is adapted for retaining damping fluid therein;

said door hinge further comprises a damping unit including a sliding member that is disposed in said connecting hole and between said resilient unit and said camshaft, that abuts against said camshaft, that is movable along the connecting axis, and that cooperates with said shaft seat and said camshaft to define a fluid chamber which overlaps a portion of said connecting hole;

the damping fluid flows into said fluid chamber when said camshaft is rotated from the normal state to the inclined state; and the damping fluid flows out of said fluid chamber when said camshaft is rotated from the inclined state to the normal state.

5. The door hinge as claimed in claim 4, wherein:

said sliding member of said damping unit is formed with a fluid hole that spatially interconnects said fluid chamber and said connecting hole;

said damping unit further includes a valve subunit that is disposed between said sliding member and said resilient unit, and that includes a stationary plate formed with a valve hole spatially communicating with said fluid hole and said connecting hole, and a valve plate disposed between said receiving plate and said sliding member, and being movable relative to said stationary plate between an open position during the movement of said camshaft from the normal state to the inclined state, where said valve plate is away from said valve hole to permit the damping fluid inside said sliding member to flow into said fluid chamber via said valve hole, and a closed position during the movement of said camshaft from the inclined state to the normal state, where said valve plate covers said valve hole to block the damping fluid in said fluid chamber from flowing through said valve hole.

6. The door hinge as claimed in claim 1, wherein:

said resilient unit includes a first coil spring, a second coil spring and a third coil spring, each of said first, second and third coil springs surrounding the connecting axis and having a plurality of coils, said coils of said first, second and third coil springs constituting said coils of said resilient units; and a length of said first coil spring along the connecting axis is different from at least one of a length of said second coil spring along the connecting axis and a length of said third coil spring along the connecting axis.

7. The door hinge as claimed in claim 6, wherein:

said connecting hole further has a third section, said second section interconnecting said first section and said third section;

the length of said third coil spring is greater than the length of said first coil spring and is smaller than the length of said second coil spring;

a difference between the length of said second coil spring and the length of said third coil spring equals the length of said first section of said connecting hole along the connecting axis;

a difference between the length of said third coil spring and the length of said first coil spring equals the length of said second section of said connecting hole along the connecting axis; and the length of said first coil spring equals the length of said third section of said connecting hole along the connecting axis.

8. The door hinge as claimed in claim 6, wherein said camshaft is rotatable about the shaft axis between a normal state, where said coils of said resilient unit are not compressed by said camshaft, and an inclined state, where said camshaft is rotated by an angle from the normal state, and where said coils of said resilient unit are compressed by said camshaft.

9. The door hinge as claimed in claim 8, wherein:

said connecting hole is adapted for retaining damping fluid therein;

said door hinge further comprises a damping unit including a sliding member that is disposed in said connecting hole and between said resilient unit and said camshaft, that abuts against said camshaft, that is movable along the connecting axis, and that cooperates with said shaft seat and said camshaft to define a fluid chamber which overlaps a portion of said connecting hole;

the damping fluid flows into said fluid chamber when said camshaft is rotated from the normal state to the inclined state; and the damping fluid flows out of said fluid chamber when said camshaft is rotated from the inclined state to the normal state.

10. The door hinge as claimed in claim 9, wherein:

said sliding member of said damping unit is formed with a fluid hole that spatially interconnects said fluid chamber and said connecting hole;

said damping unit further includes a valve subunit that is disposed between said sliding member and said resilient unit, and that includes a stationary plate formed with a valve hole spatially communicating with said fluid hole and said connecting hole, and a valve plate disposed between said receiving plate and said sliding member, and being movable relative to said stationary plate between an open position during the movement of said camshaft from the normal state to the inclined state, where said valve plate is away from said valve hole to permit the damping fluid inside said sliding member to flow into said fluid chamber via said valve hole, and a closed position during the movement of said camshaft from the inclined state to the normal state, where said valve plate covers said valve hole to block the damping fluid in said fluid chamber from flowing through said valve hole.

11. The door hinge as claimed in claim 1, wherein:

said resilient unit includes a resilient member that surrounds the connecting axis, and that has a plurality of coils constituting said coils of said resilient unit; and a pitch of any adjacent pair of coils of said resilient member in said first section is greater than a pitch of any adjacent pair of coils of said resilient member in said second section.

12. The door hinge as claimed in claim 11, wherein said camshaft is rotatable about the shaft axis between a normal state, where said coils of said resilient unit are not compressed by said camshaft, and an inclined state, where said camshaft is rotated by an angle from the normal state, and where said coils of said resilient unit are compressed by said camshaft.

13. The door hinge as claimed in claim 12, wherein:

said connecting hole is adapted for retaining damping fluid therein;

said door hinge further comprises a damping unit including a sliding member that is disposed in said connecting hole and between said resilient unit and said camshaft, that abuts against said camshaft, that is movable along the connecting axis, and that cooperates with said shaft seat and said camshaft to define a fluid chamber which overlaps a portion of said connecting hole;

the damping fluid flows into said fluid chamber when said camshaft is rotated from the normal state to the inclined state; and the damping fluid flows out of said fluid chamber when said camshaft is rotated from the inclined state to the normal state.

14. The door hinge as claimed in claim 13, wherein:

said sliding member of said damping unit is formed with a fluid hole that spatially interconnects said fluid chamber and said connecting hole;

said damping unit further includes a valve subunit that is disposed between said sliding member and said resilient unit, and that includes a stationary plate formed with a valve hole spatially communicating with said fluid hole and said connecting hole, and a valve plate disposed between said receiving plate and said sliding member, and being movable relative to said stationary plate between an open position during the movement of said camshaft from the normal state to the inclined state, where said valve plate is away from said valve hole to permit the damping fluid inside said sliding member to flow into said fluid chamber via said valve hole, and a closed position during the movement of said camshaft from the inclined state to the normal state, where said valve plate covers said valve hole to block the damping fluid in said fluid chamber from flowing through said valve hole.

15. The door hinge as claimed in claim 1, wherein:

said first moving member has a securing subunit that protrudes toward said second moving member;

said camshaft has two end portions that are transverse to said protruding subunit; and said rotating unit further includes two shaft fasteners that extend in a direction of the connecting axis from said protruding subunit, and that respectively engage said two end portions of said camshaft.

* * * * *